United States Patent [19]

Miyai et al.

[11] Patent Number: 4,635,010

[45] Date of Patent: Jan. 6, 1987

[54] PORTABLE ELECTROPHOTOGRAPHIC COPY MACHINE

[75] Inventors: Kiyoshi Miyai; Shuhei Uotani, both of Himeji; Toyohiko Tsunemine, Hyogo, all of Japan

[73] Assignee: Sanyo Electric Co., Ltd., Japan

[21] Appl. No.: 700,681

[22] Filed: Feb. 12, 1985

[30] Foreign Application Priority Data

| | | | |
|---|---|---|---|
| Feb. 16, 1984 | [JP] | Japan | 59-27595 |
| Feb. 22, 1984 | [JP] | Japan | 59-33129 |
| Feb. 22, 1984 | [JP] | Japan | 59-25001[U] |
| Sep. 7, 1984 | [JP] | Japan | 59-188459 |

[51] Int. Cl.[4] ..... G03G 15/00

[52] U.S. Cl. ..... 355/3 R; 355/3 SH; 355/21; 294/139

[58] Field of Search ..... 355/3 R, 3 DR, 3 BE, 355/14 R, 21, 3 SH, 72; 294/138, 139, 141

[56] References Cited

U.S. PATENT DOCUMENTS

| | | | |
|---|---|---|---|
| 3,286,589 | 11/1966 | Glidden | 355/21 |
| 4,181,424 | 1/1980 | Okada et al. | 355/8 |
| 4,456,362 | 6/1984 | Masaki | 355/3 R |
| 4,465,359 | 8/1984 | Nakahata | 355/3 R |
| 4,490,033 | 12/1984 | Gage et al. | 355/3 R X |
| 4,521,099 | 6/1985 | Katayama et al. | 355/8 |

FOREIGN PATENT DOCUMENTS

| | | |
|---|---|---|
| 56-11474 | 2/1981 | Japan . |
| 57-6858 | 1/1982 | Japan . |

*Primary Examiner*—A. C. Prescott

*Attorney, Agent, or Firm*—Darby & Darby

[57] ABSTRACT

An electrophotographic copying machine includes a support plate for receiving originals of documents to be copied, the support plate being mounted for sliding laterally in reciprocation along the upper surface of the housing or body of the machine; a handle attached to a side or end of the housing farthest from the center of gravity of the machine for facilitating carrying of the machine, and lifting of the machine to stand on the opposite end or side; a pair of cushions mounted at opposite ends of the opposite side for protecting the body and the top of a sheet feed tray protruding therefrom when the machine is standing on the opposite side of and a lock member for restraining the original support plate from sliding out of the body when the machine is being transported or standing on the opposite end, whereby the lock member engages a power switch for preventing operation of the machine during restraining of the support plate.

9 Claims, 9 Drawing Figures

PORTABLE ELECTROPHOTOGRAPHIC COPY MACHINE

BACKGROUND OF THE INVENTION

1. Field of the Invention

This invention relates to an electrostatographic apparatus, such as an electrophotographic copying apparatus or a printer, small-sized and lightweighted and capable of taking a different posture when in use from when out of use.

2. Description of the Prior Art

Conventionally, the electrophotographic copying apparatus, which is large-sized and heavy, should be transported always by two persons in such a manner that they draw out the retractable handles provided at four corners of the body of copying apparatus and grip two handles respectively.

Therefore, a small-sized and lightweighted electrophotographic copying apparatus has hitherto been developed which weighs 20 kg or less and transportable by only one person. Such copying apparatus, however, has been difficult to transport because he must lift the body by his both hands holding the bottom thereof.

Also, a copying apparatus provided at the side wall with a handle is disclosed in the Japanese Patent Laid-Open No. 56-11474 (1981), which is provided with a manual sheet feed plate at the side wall counter to the handle mounted side wall, the manual sheet feed plate or the side wall therefor, being not at all protected. Hence, he cannot place the copying apparatus body on the floor while holding the body by gripping the handle by his hand. Furthermore, when he turns by a quarter the body from the horizontal operating posture to the vertical transporting, there is a fear that the corner of bottom of body hits the floor to lead to a breakdown.

Also, the small-sized and lightweighted copying apparatus usually provides an original support plate which is adapted to slide along the upper surface of the body when operated so that the original support plate has a fear of sliding down to be broken when the person intends to transport the apparatus while gripping the handle.

OBJECTS OF THE INVENTION

In the light of the above problem, this invention has been designed. A first object of the invention is to provide an electrostatographic apparatus which is easy to transport the apparatus body and has no fear that, when the body is placed on the floor or the like in a transporting posture, the side wall or accessories are liable to be broken.

A second object of the invention is to provide an electrostatographic apparatus which is easy to change the apparatus body from its operating posture to its transporting posture.

A third object of the invention is to provide an electrostatographic apparatus having no fear of breaking the original support plate during the transportation.

A fourth object of the invention is to provide an electrostatographic apparatus which is preventable of breakdown of accessories, such as the original support plate or the drive system, such as a motor, when the apparatus is operated after the apparatus body is transported.

The above and further objects and features of the invention will more fully be apparent from the following detailed description with accompanying drawings.

DETAILED DESCRIPTION OF THE INVENTION

Figure 1:
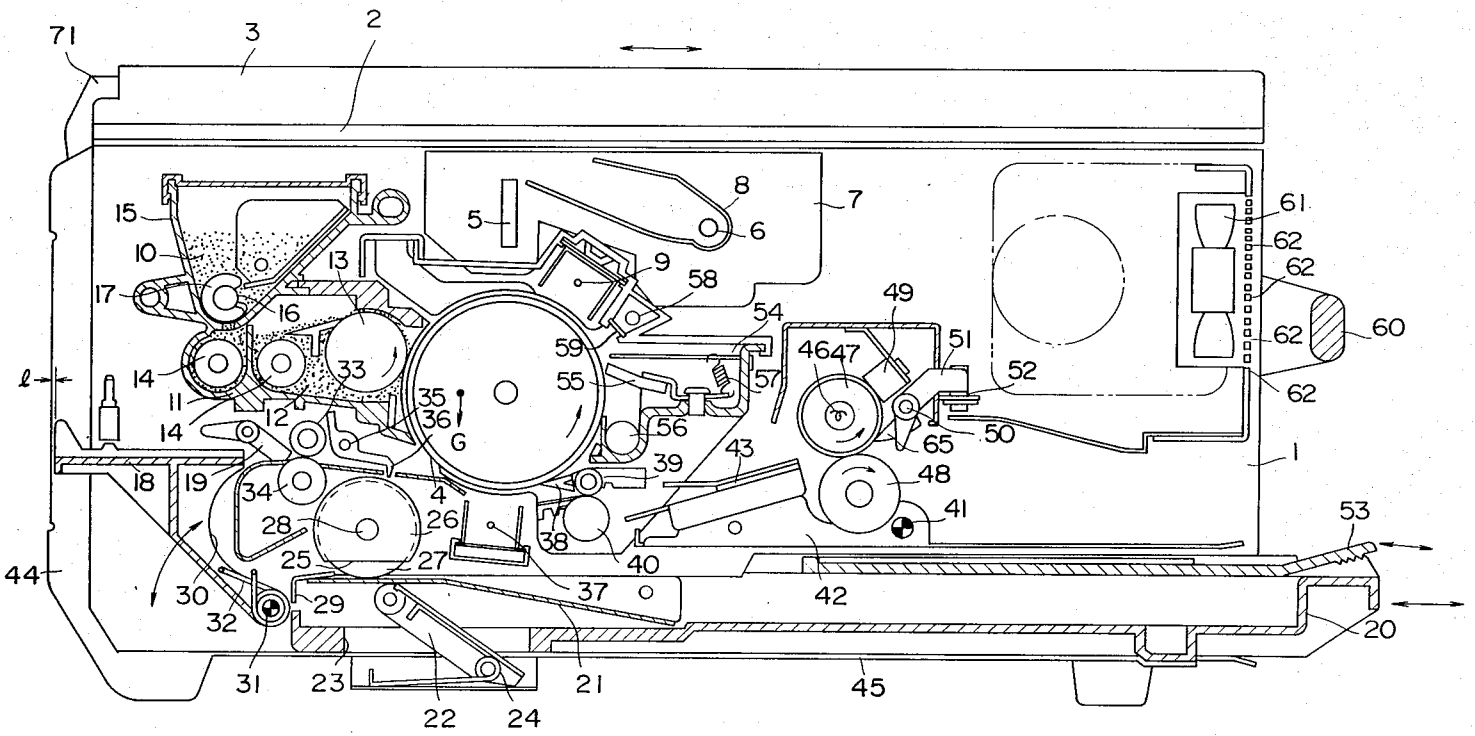
FIG. 1 is a longitudinal sectional view of an embodiment of an electrostatographic apparatus of the invention.
Figure 2:
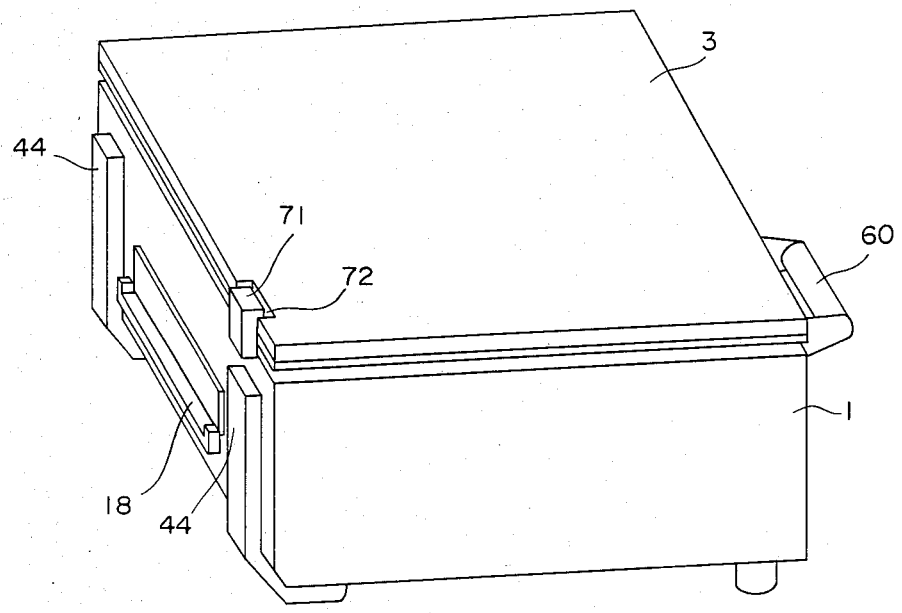
FIG. 2 is a perspective view of the FIG. 1 embodiment.

Referring to FIG. 1, reference numeral 1 designates the body of the electrostatographic apparatus of the invention, and at the upper surface of the body 1 is disposed slidably an original support plate 2 of transparent glass and movable horizontally, so that a cover 3 for holding the original is mounted onto the original support plate 2 in relation of freely closing and opening, and 4 designates a photosensitive drum comprising a cylinder of aluminum, whose peripheral surface is coated with polyvinyl carbazole. A short focus lens train 5 for forming on the peripheral surface of photosensitive drum 4 images of the original placed on the original support plate 2 is suspended opposite to the top of photosensitive drum 4. Rightwardly in the FIG. 1 of the short focus lens train 5 is provided an exposing lamp 6 (halogen lamp) which serves to illuminate the face of original and provides a reflector 8 elliptic in section, the short focus lens train 5 and exposing lamp 6 being fixed on a common chassis.

At the upstream side of short focus lens train 5 in the rotation direction of photosensitive drum 4 is fixed an electrifying corotron 9 for uniformly plus-electrifying (at about 600 V) the photosensitive drum 4.

At the downstream side of lens train 5 in the rotation direction of photosensitive drum 4 is provided a developing unit 11 for developing with toner 10 electrostatic latent images formed on the photosensitive drum 4 by means of electrifying corotron 9 and short focus lens train 5 and the like, the developing unit 11 housing therein a magnet roller 13 for transporting toward the surface of electrosensitive drum 4 a developer 12 of mixture of toner 10 and a carrier and a screw 14 for mixing the toner and carrier, the roller 13 and screw 15 being rotatable in the developing unit 11. Reference numeral 15 designates a toner hopper fixed integrally with the upper portion of developing unit 11. The toner hopper 15 provides at the bottom thereof a sponge roller 17 having a cutout 16 in part for feeding the contained toner 10 little by little to the developing unit 11.

Reference numeral 18 designates a sheet feed plate for manually feeding a copy paper into the apparatus and at the downstream side of sheet feed plate 18 in the paper feed direction is provided a start switch 19 serving also as a jam sensor, and 20 designates a sheet feed cassette mounted detachably and horizontally to the inner bottom of the body 1 of electrostatographic apparatus. The sheet feed cassette 20 is insertably mounted leftwardly of the body 1 from the right hand thereof and provides on the bottom inner surface a support plate 21 swingably up and downwardly and for loading sheet of copy papers (not shown), and below the support plate 21 is provided an opening 23 through which the free end of a push-up lever 22 mounted swingably up and downwardly into a portion projecting outwardly from the bottom of body 1 is passable, the push-up lever 22 providing a torsion spring 24 for biasing it to rotate clockwise so that the spring 24 biasing the support plate 21 upwardly. Above the end of sheet feed cassette 20 at the downstream side thereof in the paper feed direction is provided a sheet feed roller 26 for feeding a copy paper one by one and of a high frictional material, such as rubber, and having a cutout 25 in part. Reference numeral 27 designates an idler of low frictional material, such as plastics and fitted freely rotatably to a spindle 28 of sheet feed roller 26 in order to prevent the cutout 25 from contacting with the copy paper, and 29 designates a corner separator for separating the copy paper one by one.

At the downstream side of sheet feed cassette 20 in the paper feed direction is provided a guide 30 to turn upwardly the copy paper fed by the sheet feed roller 26, the guide 30 being integral with the manual sheet feed plate 18 and rotatable counterclockwise around a support spindle 31 inserted into the lower end of guide 30, and 32 designates a torsion spring for biasing the guide 30 clockwise.

At the downstream side of guide 30 in the paper feed direction is provided a pair of register rollers 33 and 34 for feeding in synchronism with sliding of original support plate 2 the copy paper transported from the sheet feed cassette 20 or sheet feed plate 18, the lower register roller 34 being connected to a drive source so as to rotate continuously. Also, the pair of register rollers 33 and 34 are in relatively light press-contact with each other and adapted to feed the copy paper when not restricted by other means (discussed below), but slip to the same when restricted by other means.

At the downstream side of pair of register rollers 33 and 34 in the paper feed direction is provided a stopper 36 mounted rotatably to a support spindle 35, the stopper 36 is bent in L-like shape at the free end and insertably engageable or disengageable at the tip thereof with or from a paper feed passage. Accordingly, when the tip of stopper 36 insertably engages with the paper feed passage, the copy paper fed is restricted at its fore end of the downstream side in the feed direction thereof by the tip of stopper 36, thereby being put in slip condition to the register rollers 33 and 34, and then the tip retracts to disengage from the paper feed passage at the proper timing, thereby refeeding by the register rollers 33 and 34 the copy paper having temporarily been stopped by the stopper 36.

Below the photosensitive drum 4 is provided a corotron 37 to transfer to the copy paper the toner images developed by the developing unit 11. At the downstream side of the transfer corotron 37 in the rotation direction of photosensitive drum 4 is disposed adjacent thereto a peel-off pawl 38 for peeling off the copied paper from the photosensitive drum 4, the peel-off pawl 38 being mounted rotatably to a support shaft for the upper one 39 of a pair of carrier rollers 39 and 40 and biased at the utmost end to rotate toward the peripheral surface of photosensitive drum 4.

At the downstream side of pair of carrier rollers 39 and 40 in the paper feed direction is provided a sheet feet guide 43 and at the downstream side thereof is provided a fixing unit comprising a heat roller 47 insertably supporting therein a halogen lamp 46 of about 800 W and a pressure roller 48 in press-contact with the heat roller 47.

Slantwise upwardly of the heat roller 47 is provided to be slidable thereto a temperature sensor 49 of silicon rubber and having a thermister embedded in the surface of sensor 49 and for sensing a temperature of heat roller 47. In addition, a peel-off pawl 65 for peeling the copy paper from the heat roller 47 is provided.

At the downstream side of the fixing unit in the paper feed direction is provided a C-like-shaped lever 51 supported at a portion lower than its center of gravity rotatably by a support spindle 50 and at the downstream side of lever 51 is provided a photocoupler 52 whose optical path is selectively interrupted by the lever 51. The photocoupler 52 serves as a sensor for the lever 51 and is connected to a copy start switch through a control circuit (both are not shown), so that when the lever 51 interrupts the optical path of photocoupler 52 in a stand-by condition for the copying operation, the copying operation is adapted not to start even when the copy start switch is actuated. Also, the lever 51, when the copy paper is discharged from the fixing unit, comes into contact with the copy paper and rotates counterclockwise around the support spindle 50 to release the interrupted optical path of photocoupler 52.

Now, the copy paper fixed of toner images by the fixing unit is discharged onto a sheet discharge tray 53 provided above the sheet feed cassette 20. In addition, the sheet discharge tray 53 is constructed to come out or retract longitudinally with respect to the body 1 and be housed therein when not used.

At the downstream side of the peel-off pawl 38 in the rotation direction of photosensitive drum 4 (upwardly thereof in the drawing) is provided a cleaning unit 54 for removing from the photosensitive drum 4 the toner not completely transferred to the copy paper but remaining to the photosensitive drum 4, the cleaning unit 54 housing therein a rubber blade 55 for scraping off the residual toner from the photosensitive drum 4 and a screw conveyor 56 to discharge the scraped toner. The blade 55 is provided with a spring 57 for biasing the utmost end of blade 55 toward the photosensitive drum 4, an erase lamp 58 for removing the residual charge completely from the drum 4 is provided at the downstream side of cleaning unit 54 (upwardly in the drawing), and the erase lamp 58 has a filter 59.

A handle 60 for raising or lifting the body 1 is fixed at the right-hand side wall of the body 1, that is, at the side wall on which the sheet feed cassette 20 and sheet discharge tray 53 are mounted. At the side wall (the left-hand side wall) counter to that mounting the handle 60, that is, the side wall carrying the manual sheet feed plate 18, are fixed a pair of prism-like-shaped rubber cushions 44, 44 extending vertically, the lower ends of which are mounted to the bottom of the body 1. The rubber cushion 44, 44 projects by a length l from the utmost projecting end of the sheet feed plate 18, thereby serving to protect the projecting end of sheet feed plate 18 and the body 1 when the person places the body 1 on the ground in a lifting posture by gripping the handle 60, the lower ends of rubber cushions 44 functioning as the legs for the body 1 when in use. A lock member 71 is mounted vertically slidably to the side surface carrying the rubber cushions 44, 44, bent somewhat toward the handle 60 mounting side wall, and engageable with a recess 72 at a cover 3 on the original support plate 2 and a recess 73 at the upper surface of the body 1.

Figure 3:
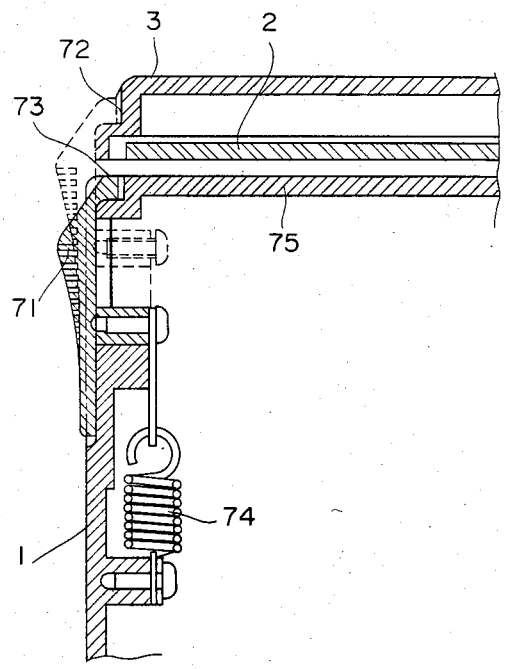
FIG. 3 is a sectional view of the principal portion of the same, FIGS. 4-(A), -(B) and -(C) are sectional views explanatory of the steps of turning the apparatus body at an angle of 90°.

Also, the lock member 71, as shown in FIG. 3, is retained to one end of a tension spring 74 housed within the body 1, thereby being biased always in the retracting direction with respect to the upper plate 75 at the body 1.

Also, reference numeral 61 designates a cooling fan provided inside the side wall fixedly supporting the handle 60, which exhausts air outwardly through a number of air exits 62, 62 . . . . Thus, in a case where the cooling fan 61 is provided at the side wall carrying the handle 60, the air exits 62, 62 . . . do not face the floor or the like even when the body 1 is raised while rotating the cooling fan 61, thereby not deteriorating the exhaust efficiency.

Now, after the original is placed on the original support plate 2, the copy start switch is energized, then the original support plate 2 slides leftwardly, so that the original images are projected and image-formed on the photosensitive drum 4 during the sliding of original support plate 2 and the electrostatic latent images corresponding to the original images are formed on the photosensitive drum 4. Then, the electrostatic latent images are toner-developed at the developing unit 11 and the developed toner images are transferred by the transfer corotron 37 to the copy paper fed from the sheet feed cassette 20. Thus, the copy paper on which the toner images are transferred is peeled off by the peel-off pawl 30 from the photosensitive drum 4 and heated and pressurized by the fixing unit and thereafter discharged onto the sheet discharge tray 53.

In addition, the residual charge and toner which is not transferred to the copy paper but remains on the photosensitive drum 4 are removed therefrom by the erase lamp 58 and cleaning unit 54 respectively.

In such electrostatographic apparatus, the center of gravity is biased leftwardly from the axis of rotation of photosensitive drum 4, in other words, leftwardly from the center of body 1 of sliding dimensional of the original support plate 2. Accordingly, the handle 60 is provided at the side wall apart farther from the center of gravity than the opposite side wall.

Figure 4A:
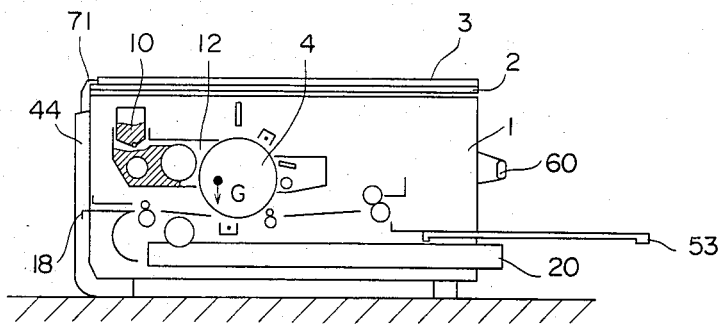
Figure 4B:
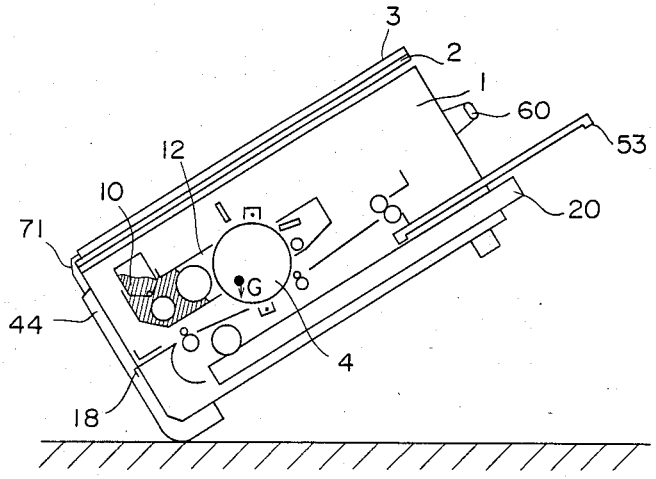
Figure 4C:
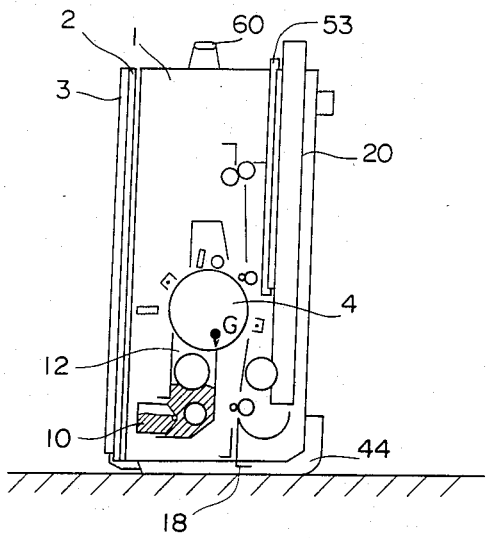

FIGS. 4-(A), -(B) and -(C) show the steps of inclining the body 1 by 90° from the horizontal position where the apparatus is operated to the position where the apparatus is not operated and lengthwise upright. In a case where the body 1 is intended to be raised lengthwise upright on the floor, the lock member 71 is lifted against the tension spring 74 to engage the bent portion of lock member 71 with the recess 72 at the cover 3 to thereby lock the original support plate 2 and then the handle 60 is held to turn the body 1 by 90°. In such case, the rubber cushions 44, 44 at the counter side wall to the handle 60 mounted side wall, which are prism-like-shaped and extend to the bottom of body 1, are always kept in contact in part with the floor to turn the body 1 by 90°, whereby a relatively smaller strength only is required and the corner of body 1 has no fear of breakdown. Also, the original support plate 2, which is locked by the lock member 71, does not slide down along the upper surface of body 1.

Furthermore, since the center of gravity G of body 1 is biased toward the side wall carrying the rubber cushions 44, 44, the labor to turn the body 1 is saved, and when the body 1 is raised lengthwise upright on the floor, a height of the center of gravity G from the floor is a half or less of length of the moving length of the original support plate 2, thereby keeping the body 1 stable. Also, when the body 1 is raised, the manual sheet feed plate 18 is kept at its projecting end above the projecting surface of each rubber cusuion 44, thereby being kept a space from the floor, where the sheet discharge tray 53 is housed by its own weight into the body 1. In addition, the toner 10 within the toner hopper 15 and the developer 12 in the developing unit 11 are biased at the reverse side with respect to the photosensitive drum 4.

In a case where the apparatus body 1 is intended to be inclined by 90° reversely from its lengthwise upright standing posture to a horizontal operation posture, the original support plate 2 need only be moved toward the side wall reverse to the lock member 71 mounted side wall, so that the bent portion of lock member 71 disengages from the recess 72 at the cover 3 and the lock member 71 is retracted from the upper surface of the body 1 by the tension spring 74, thereby making the original support plate 2 slidable in reciprocation along the upper surface of body 1.

Incidentally, when the original support plate 2 is set to slide initially toward the opposite side to the lock member 71, the person can immediately operate the apparatus without releasing the lock member 71. In other words, when he starts copying operation after the body 1 is placed on a horizontal base, the original support plate 2 at first slides away from the lock member 71 (in the direction of releasing it), thereby being automatically unlocked as abovementioned. Hence, the lock member 71 cannot hinder the sliding of original support plate 2 toward the lock member 71 mounted side even when returned.

Figure 5:
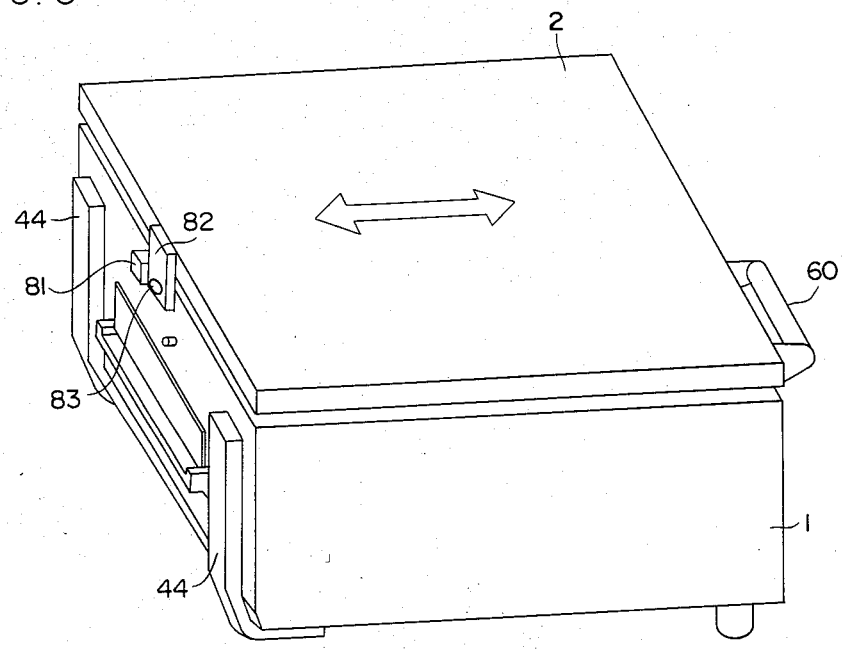
FIG. 5 is a perspective view of a modified embodiment of the invention.
Figure 6:
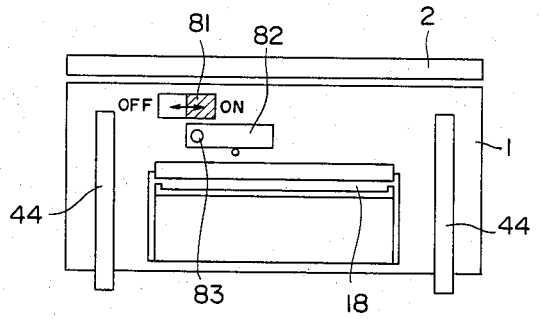
FIGS. 6 and 7 are side views explanatory of operation of the FIG. 5 embodiment.
Figure 7:
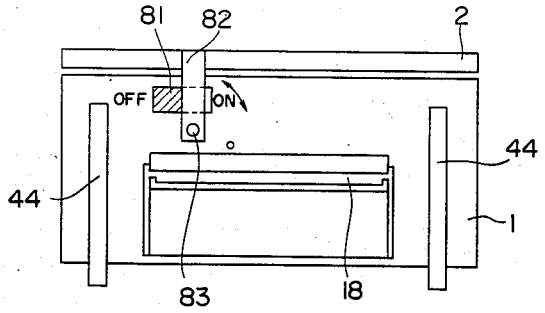

FIG. 5 shows a modified embodiment of the invention, in which a slide switch 81 as a power supply switch and a lock lever 82 for locking the original support plate 2, are mounted at the counter side wall to the handle 60 mounted side wall, the lock lever 82 being mounted swingably onto a pin 83 provided at the side wall, so that when not locking the original support plate 2 as shown in FIG. 6, the lock lever 82 is positioned to allow the slide switch 81 to be open or closed, and when locking the same as shown in FIG. 7, the lock lever 82 is positioned to restrain the slide switch 81 from moving to be closed. Accordingly, the slide switch 81 is restrained from closing while the lock lever 82 locks the original support plate 2, and allowed to close while the lock lever 82 is not locking the same.

In addition, reference numeral 44 designates the aforesaid prism-like-shaped rubber cushion and 18 designates the manual sheet feed plate.

Alternatively, the slide switch 81 may be used as a copy start switch instead of the power supply switch as abovementioned. Also, the copy start switch or the like, when the slide switch 71 is open, may not be operable, thereby not actuating the apparatus.

Also, when the lock lever 82 is turned to the locking position, the original support plate 2, even when lifted by the person gripping the handle 60, is locked by the lock lever 82 not to slide along the upper surface of body 1.

Furthermore, even when the person intends to close the slide switch 81 in the locking condition of lock lever 82, the slide switch 81 is locked, whereby the power source is not turned on. Hence, the copying operation cannot start because the original support plate 2 is locked.

In addition, the lock lever 82, when turned to the unlock position, allows the slide switch to be on, thereby enabling the copying operation.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. An electrophotographic machine including apparatus for protecting the machine when standing on end or in transport, and for facilitating manual transport of the machine, said apparatus comprising:

a housing serving as an outer body including in an operating position of said machine, a bottom, top, rear side front side, and right-hand and left-hand sides;

a handle rigidly mounted on said front side of said housing;

a sheet feed cassette, and a sheet discharge tray, respectively, each being slideably mounted through openings in the front side of said housing, a manual sheet feed plate projecting from the rear side of said housing; and cushion members mounted upon the rear side of said housing, said cushion members projecting away from the rear side to a greater extent than said sheet feed plate, whereby whenever said apparatus is lifted to stand on a surface upon its rear side, said cushion members serve to both protect said housing and said sheet feed plate, by preventing the latter from contacting the aforesaid surface.

2. The apparatus of claim 1, wherein said cushion members include a pair of belt-like shaped materials extending vertically upward relative to the bottom of said housing.

3. The apparatus of claim 2, wherein said pair of belt-like shaped materials extend beyond and bend around a corner edge of said housing common to the rear side and bottom of said housing, for attachment to the bottom, whereby whenever said machine is in its operative position, the portion of said cushion members attached to the bottom serve as "cushioned feet" for said housing.

4. The apparatus of claim 3, wherein the center of said machine is biased away from the dimensional center of said machine toward the rear side of said housing, for both ensuing stability of said machine when standing on its rear side, and relative ease of transportability.

5. An electrophotographic copying machine which is provided with an original support plate sliding laterally in reciprocation along the upper surface of the body thereof, a lock member to restrain said original support plate from sliding out from said body, and a handle for transporting said apparatus thereby, said handle mounted onto one side of the body, characterized in that said lock member is connected to a predetermined switch at said body, for preventing operation of said switch, and thereby operation of said machine, whenever said original support plate is restrained by said lock member.

6. An electrophotographic copying machine, comprising:

a housing including relative to an operating position for said machine, a bottom, a top, a rear side, a front side, a right-hand side, and a left-hand side;

an original support plate for receiving a document for copying, said original support plate being slideably mounted on the top of said housing, for sliding laterally in reciprocation along the top surface;

an electrical switch mounted on the rear side;

locking means mounted on the rear side of said housing, for both preventing movement of said original support plate away from said housing, and operation of said electrical switch to a "turned-on" position, thereby preventing operation of said machine and placing said machine in a condition for either transport or standing on the rear side; and cushion means mounted upon the rear side of said housing and extending therefrom along a portion of the bottom of said housing, for protecting said housing when said machine is either in an operative position resting on its bottom, or in an inoperative position resting on its rear side.

7. An electrostatographic apparatus as set forth in claim 5, wherein said switch is a power supply switch.

8. An electrostatographic apparatus as set forth in claim 5, wherein said switch is an operation start switch.

9. An electrostatographic apparatus as set forth in claim 5, wherein said switch is a switch to forbid all the operations of the apparatus.

* * * * *